United States Patent [19]

Bryan

[11] Patent Number: 5,067,613

[45] Date of Patent: Nov. 26, 1991

[54] GABLE TOP CARTON WITH INTERIORLY STORED RECLOSABLE SPOUT

[76] Inventor: William T. Bryan, 927 Garnoa Dr., Cincinnati, Ohio 45231

[21] Appl. No.: 699,219

[22] Filed: May 13, 1991

[51] Int. Cl.[5] ..... B65D 5/70; B65D 5/74

[52] U.S. Cl. ..... 229/214; 229/125.04; 229/216

[58] Field of Search ..... 206/621.1, 621.2, 631.3, 206/626; 229/125.04, 125.09

[56] References Cited

U.S. PATENT DOCUMENTS

| | | | |
|---|---|---|---|
| 922,277 | 5/1909 | Gowing | 229/125.04 |
| 968,717 | 8/1910 | Vaughan | 229/125.04 |
| 2,077,341 | 4/1937 | Martin et al. | 229/125.04 |
| 2,332,205 | 10/1943 | Clanon | 206/621.2 |
| 2,576,595 | 11/1951 | Goldstein | 206/621.2 |
| 2,601,399 | 6/1952 | Jones | 206/621.1 |
| 3,487,985 | 1/1970 | Spangler | 229/125.04 |
| 3,770,185 | 11/1973 | Reeves | 206/621.1 |
| 4,953,781 | 9/1990 | Bryan | 229/125.04 |

*Primary Examiner*—Gary E. Elkins
*Attorney, Agent, or Firm*—Roy F. Schaeperklaus

[57] ABSTRACT

A gable top carton of conventional external configuration having an openable and reclosable tamper indicating, damage resistant and non-interfering with stacking pouring spout is provided comprising a spout flap defined by lines of weakening in a rectangular roof panel and associated seal panel and a spout web member having a central panel attached to the inward face of the flap, outer glue panels attached to the rectangular roof panel adjacent but spaced from the spout flap and accordian pleat panels articulated to respective sides of the central panel and respective outer glue panels. The carton may have an inner seal panel having its peripheral edge sealed to the inward face of the carton blank to provide therewith a minor chamber containing the accordian pleat panels and adjacent central portion of the web member. Coupons or other things for consumers can be enclosed in the minor chamber out of contact with product in the major chamber. The minor chamber and major chamber can be opened by jointly tearing both the spout flap open and the underlying portion of the seal panel from the rest of that panel. The underlying portion of the seal panel can be in tension to urge enclosures in the minor chamber to remain on the central web portion as the spout is moved to fully open position. The spout may be reclosed and, by finger pressure adjacent the carton seal seam, resealed during shaking to mix contents.

19 Claims, 6 Drawing Sheets

GABLE TOP CARTON WITH INTERIORLY STORED RECLOSABLE SPOUT

This invention relates to an improved gable top carton having a reclosable pouring spout therein. More particularly, this invention relates to a gable top carton having a pouring spout in the roof thereof and to a plurality of flat paperboard, paper or other carton material blanks for forming a gable top carton with a pouring spout therein.

BACKGROUND OF THE INVENTION

Gable top cartons are widely used in packaging, storing and dispensing flowable material. A typical prior art gable top carton comprises a generally planar bottom wall, side walls connected to and extending upwardly from the bottom wall, and a gable top articulated to the side walls of the carton and formed by a plurality of generally planar panels articulated in sequence to one another.

The panels forming the gable top of the prior art carton comprise a pair of rectangular roof panels and six triangular panels. The roof panels are articulated to opposite side wall portions of the prior art carton. The triangular panels of the prior art gable top are arranged to form an opposed pair of gable ends consisting of three triangular panels. The three triangular panels in each of the pair of gable ends are articulated consecutively to each other and to the rectangular roof panels and to the end walls of the prior art carton to form respective gable ends of the prior art carton.

The prior art gable top carton is closed by folding the triangular panels inwardly relative to the rectangular roof panels and by securing the top edge regions of the rectangular roof panels and the triangular panels in face-to-face relationship in a ridge seam.

One end gable of the carton is the pour spout end. Triangular portions of the rectangular roof panels which overlie and are articulated to triangular panels of the pour spout gable are provided with fold lines for articulating triangular portions of the roof panels in relation to the balance of the respective rectangular roof panel. The prior art gable top carton then can be opened by separating portions of the secured top edge regions by folding the roof edges respectively articulated to the end edges of the pour spout gable end one of the pairs of three triangular panels and overlying portions of the roof panels upwardly and outwardly and then swinging the gable edges toward the adjacent end of the carton to place the three triangular panels in a relation in which they define a pouring spout projecting from the gable end of the carton. The three triangular panels defining the pouring spout on the prior art gable top carton selectively can be refolded inwardly to temporarily reclose the carton or outwardly for pouring the flowable material stored in the carton.

The proper sealing of the top of a gable top carton requires careful selection and application of adhesive materials adjacent the top edge regions of the top panels. More particularly, the closure of the top of the prior art gable top carton must be sufficiently secure to prevent leakage or spoilage of the flowable material stored in the container. However, at least one-half of the top edge regions of the top panels must be capable of being opened relatively easily to permit the material stored in the container to be poured. This initial opening must be non-destructive to ensure an efficient pouring spout and to enable subsequent reclosings and reopenings of the top. An imprecise application of adhesive adjacent the top edge regions of the top panels can make it extremely difficult to initially open the carton, or conceivably could lead to leakage or spoilage prior to the initial opening of the spout. Many individuals find it difficult to open a prior art gable top carton even when the carton has been sealed properly.

Recently, there have been gable top cartons developed with a selectively openable and reclosable plastic spout mounted in one of the rectangular roof panels. More particularly, a selected rectangular roof panel has been provided with an aperture extending therethrough. A plastic spout having a closure cap which can be opened and closed is then adhered to the paperboard material of the prior art carton annularly of the aperture to effectively open and close the aperture by opening and closing the spout with the cap. The object of these fairly recent prior art cartons has been to simplify the opening and reclosing of the carton, but the capped spout projecting from the normal roof panel configuration of the carton is exposed to damage by collision with other objects. The projecting capped spout also interferes with compact stacking of such gable top cartons upside down on subjacent right-side-up cartons to save space in storage. Further, the projecting capped plastic spouts also at best have minimal tamper resistance and lack tamper indication, which shoplifters have found advantageous for concealing contraband; namely, they temporarily remove the cap, insert an "item-to-be-lifted" through the spout into the container and replace the cap.

It has also been generally considered undesirable and costly to form paperboard cartons with plastic or other non-paper appurtenances. The use of plastic pouring spouts involves significant additional cost for the container and additional manufacturing steps that cannot be efficiently carried out with available paperboard carton manufacturing equipment.

An additional problem arises in disposing of the carton, as in recycling the carton, the plastic spout must be separated from the paperboard of the carton for separate recycling.

In view of the above, it is an object of the subject invention to provide a paperboard gable top carton that does not require the rectangular roof panels of the gable top to be selectively foldable to define a projecting open pouring spout and foldable to substantially retract the spout into gable forming condition to temporarily reclose the carton.

A further object of the subject invention is to provide a gable top carton formed substantially entirely from paperboard material and having an efficient reclosable spout incorporated therein.

Another object of the subject invention is to provide a paperboard gable top carton with a reclosable pouring spout formed from a paper, paperboard or flexible plastic carton sheet material member disposed inside the carton in association with a tongue portion of one of the rectangular top panels of the gable top.

A further object of the subject invention is to provide in such a paperboard gable top carton with a reclosable pouring spout, an inner seal panel having its margin regions sealingly attached to a rectangular top panel annularly of and spanning the pouring spout member and between that member and the contents of the carton and dividing the interior of the carton into two chambers isolated from each other.

Another object of the subject invention is to secure part of the seal panel between adjacent carton portions in the ridge seam.

A further object of the invention is to provide a pull tab portion of the seal panel projecting from the ridge seam and pullable to tear open the seal panel and the roof panel tongue portion of the spout to open the carton.

Another object of the invention is to form the sheet material member of the spout so that when it is stored inside the carton it forms wing flanges which project laterally of the spout tongue portion of the roof panel to engage the inward face of the roof panel and substantially secure the pour spout in reclosed position with the tongue portion flush with the roof panel.

An additional object of the subject invention is to provide a gable top carton having a reclosable pour spout that does not project from the carton until opened and is latchable in closed position with the tongue portion in substantially flush relation with the rectangular roof panel from which it is formed.

SUMMARY OF THE INVENTION

The subject invention is directed to a gable top carton having a reclosable pouring spout therein. The invention is further directed to such cartons having plural chambers connectable to each other and the pouring spout incident to the initial opening of the pouring spout. The one chamber formed by the seal panel and the rectangular roof panel of the carton serving to hold coupons, tokens or other enclosures in accessible position for the consumer upon initial opening of the carton pouring spout, the pouring spout being tamper indicating and latchable in reclosed condition. The invention is further directed to a plurality of paper, paperboard or other carton material blanks for forming a gable top carton with a pouring spout therein.

The blanks for forming the gable top carton of the subject invention comprise a carton blank formed a paperboard material which may have a fluid impervious material on one or more surfaces. The carton blank may be cut and scored to define at least one bottom wall panel, at least one side wall panel articulated to the bottom wall panel, a plurality of top wall panels consecutively articulated to one another and suitably articulated to the side wall panel, and glue panels or flaps articulated to the other panels of the carton blank to enable the carton blank to be secured in an erected condition defining a gable top carton. More particularly, the several panels of the carton blank are articulated by score lines formed therein to enable formation of a carton having a bottom wall, an upstanding side wall, and a gable top. The side walls of the carton may be defined by a plurality of generally rectangular or trapezoidal side wall panels consecutively articulated to one another. Alternatively, the side walls may be defined by a single side wall of generally cylindrical or frusto-conic configuration adjacent the bottom wall of the carton and gradually merging into a rectangular cross section adjacent the gable top. The top wall panels may comprise a pair of rectangular roof panels and a plurality of triangular panels. One of the rectangular roof panels is provided with two spaced lines of weakening extending from the top edge of the panel toward the wall edge of the panel to define a tongue flap forming part of the pouring spout.

The blanks of the subject invention further comprise a pouring spout web blank formed from a flexible, foldable material which may comprise paper. The pouring spout web blank may additionally comprise a plastic material such as polyethylene, Tyvek, or the like. The pouring spout web blank is preferably securable to the carton blank and is selectively reformable into an appropriate opened or closed condition. For example, the pouring spout blank may be formed from a paper or other cellulosic substrate coated on one or both sides, or impregnated with an appropriate plastic. As will be explained hereinafter, a preferred material for the pouring spout web blank is sold under the trademark "TYVEK" and is currently employed in packaging and envelopes. The pouring spout web blank may be scored, folded or otherwise formed to define a plurality of glue panels for secure face-to-face attachment to the inward face of a rectangular roof panel adjacent spaced lines of weakening therein defining a pouring spout tongue flap of the carton blank. The pouring spout web blank may further comprise a plurality of panels that are selectively foldable relative to the glue panels for alternately opening and closing relative to the carton blank and the carton formed therefrom. The pouring spout web blank panels may be consecutively articulated to one another and generally arranged and configured for defining an appropriate spout configuration.

The blanks of the subject invention may further comprise a seal panel blank which may be formed from the same material as the pouring spout web blank or from another sheet material having suitable properties as described hereinafter. The seal panel blank may be formed to define a pouring spout spanning panel having glue application regions that are appropriately attachable to the rectangular roof panel to provide a pouring spout chamber in which the pouring spout is in a chamber separate from the main chamber of the unopened carton.

The seal panel blank may further comprise a tear panel tab by which the seal panel may be opened concurrently with the pouring spout of the rectangular roof panel to place the main and pouring spout chambers in communication.

The pouring spout web blank and the seal panel blank may be formed as a unitary blank, if desired.

The pouring spout web blank and the seal panel blank (if provided) may be secured to the carton blank prior to erection of the carton. More particularly, a central panel of the pouring spout web blank may be adhered or otherwise secured to the inward face of the pouring spout tongue portion of the rectangular roof panel with glue free portions of the central panel of the pouring spout web blank extending across the tongue defining lines of weakening and overlying a portion of the inward face of the rectangular roof panel (to latch the pouring spout in reclosed position) and the seal panel blank secured adjacent its periphery to portions of the rectangular roof panel and pouring spout web blank to house the folded pouring spout portions and any associated enclosures.

The carton blank may then be folded and secured in erected condition in substantially the known manner employing available equipment for such purpose.

The carton may be filled with the appropriate flowable material and the gable top may then be sealed in the known manner using the available equipment for such purpose. The erected, filled and sealed gable top carton may be opened by grasping the pull tab portions of the pouring spout tongue, the pouring spout web and the seal panel tab which are in registry with one another and pulling in an upwardly outwardly direction to simultaneously separate the pouring spout tongue edges from the rectangular roof panel along the lines of weakening, tear the underlying seal panel along lines subjacent the lines of weakening, thereby concurrently opening the carton pouring spout and the carton seal panel. The carton may be reclosed by refoldingly swinging the spout inwardly until the projecting portions of the pouring spout central web are drawn through the opening in the roof panel and spread for latching engagement with the underside of the roof panel to secure the pouring spout tongue in reclosed substantially flush relation to the roof panel.

The above and other objects and features of the invention will be apparent to those skilled in the art to which this invention pertains from the following detailed description and the drawings.

BRIEF DESCRIPTION OF THE DRAWINGS

In the following detailed description and the drawings, like reference characters indicate like parts.

DETAILED DESCRIPTION OF PRESENTLY PREFERRED EMBODIMENT

Figure 6:
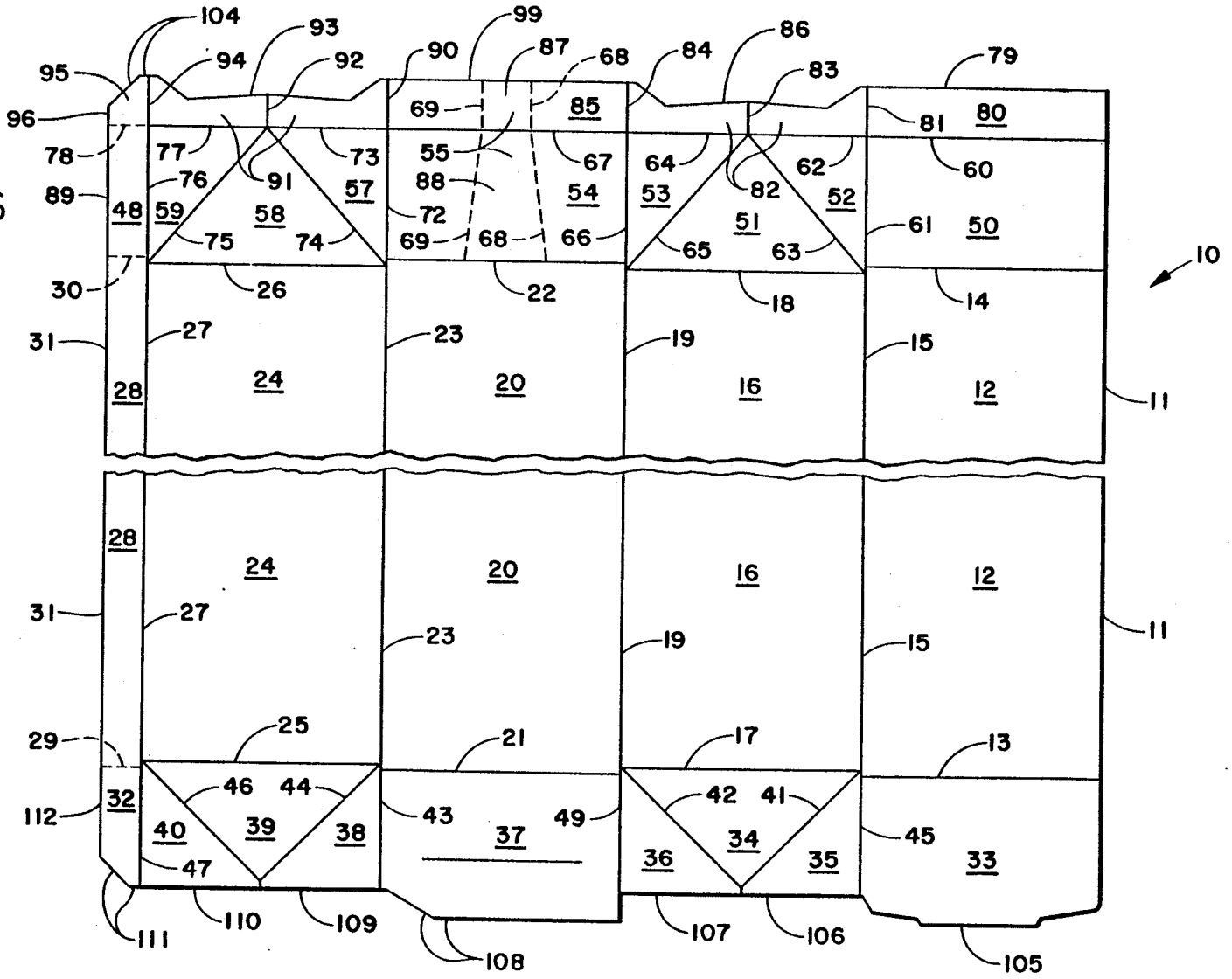
FIG. 6 is a plan view of a carton blank constructed in accordance with an embodiment of this invention.

The carton blank of the subject embodiment of the invention is illustrated in FIG. 6, and is identified generally by the reference number 10. The carton blank 10 is formed from a unitary piece of paperboard material having an array of score lines formed therein to enable the carton blank 10 to be folded and glued to define an erected gable top carton. The paperboard material of the carton blank 10 may be appropriately coated or laminated with a foil or plastic material to render the paperboard substantially impervious to liquids or solids that may be stored therein and/or to protect contents of the carton from contact with fluids that may adversely affect such contents.

The carton blank 10 comprises four rectangular side panels, first side panel 12, second side panel 16, third side panel 20 and fourth side panel 24 and a side glue flap 28, which are consecutively articulated to one another along parallel fold lines 15, 19, 23 and 27 respectively, and, extend from carton blank side edge 11 (defining an edge of panel 12 parallel to fold line 15) to carton blank side edge 31 (defining an edge of side glue flap 28). Edges 11 and 31 are parallel and parallel to fold lines 15, 19, 23 and 27. Side glue flap 28 will be adhered to first side panel 12 with carton blank edge 11 adjacent fold line 27 on the erected carton.

The first side panel 12 is further defined by parallel fold lines 13 and 14 which extend orthogonally between the blank side edge 11 and 15. A first bottom panel 33 is articulated to the first side panel 12 along fold line 13. The first bottom panel 33 is further defined by carton blank edge 11 extended, fold line 45 and carton blank edge portion 105 extending from edge 11 to fold line 45.

A rectangular first roof panel 50 is articulated to the first side panel 12 along fold line 14 and will comprise one of two upwardly converging roof panels of the carton. Rectangular roof panel 50 is further defined by carton blank edge 11 extended, fold line 60 parallel to fold line 14 from edge 11 to fold line 61, which is an extension of fold line 15. A first top seal panel 80 is articulated to rectangular first roof panel 50 along fold line 60. Top seal panel 80 is further defined by carton blank side edge 11 extended to carton top edge portion 79, which in turn extends parallel to fold line 60 to fold line 81, which is an extension of fold line 61 beyond fold line 60.

The second side panel 16 is further defined by parallel fold lines 17 and 18 which extend orthogonally between the fold lines 15 and 19. A triangular second bottom panel 34 is articulated to the second side panel 16 along fold line 17. The triangular second bottom panel 34 is further defined by converging fold lines 41 and 42. Fold panel 35 is articulated to triangular bottom panel 34 along fold line 41, articulated to the first bottom panel 33 along fold line 45, and is further defined by carton blank edge portion 106. Similarly, fold panel 36 is articulated to triangular second bottom panel 34 along fold line 42. Fold panel 36 is further defined by fold line 49 in colinear alignment with fold line 19 and by carton blank edge portion 107.

A triangular second roof panel 51 is articulated to the second side panel 16 along fold line 18. Triangular roof panel 51 is further defined by converging fold lines 63 and 65. A first top fold panel 52 is articulated to second roof panel 51 along fold line 63. The first top fold panel 52 is further defined by fold lines 61 and 62. The fold lines 61 and 62 respectively extend generally colinearly from fold lines 15 and 60. A second top fold panel 53 is articulated to second roof panel 51 along fold line 65. The second top fold panel is further defined by fold lines 64 and 66. The fold lines 64 and 66 respectively extend generally colinearly from fold lines 62 and 19. A second top seal panel 82 is respectively articulated to the first and second top fold panels 52 and 53 along fold lines 62 and 64. Top seal panel 82 is articulated to top seal panel 80 along fold line 81. Top seal panel 82 is further defined by fold line 84 extending colinearly from fold line 66, and by carton blank top edge 86 extending from fold line 81 to fold line 84.

The third side panel 20 is further defined by parallel fold lines 21 and 22 which extend orthogonally between the fold lines 19 and 23. A third bottom panel 37 is articulated to the third side panel 20 along fold line 21. The third bottom panel 37 is further defined by parallel fold lines 49 and 43 and carton blank edge portion 108 extending from fold line 49 to fold line 43, fold lines 49 and 43 being respectively colinear with fold lines 19 and 23.

The third roof panel is a rectangular roof panel 54 articulated to the third side panel 20 along fold line 22 and will comprise the second of two upwardly converging rectangular roof panels of the carton. The third top panel 54 is further defined by parallel fold lines 66 and 72 which respectively extend colinearly from fold lines 19 and 23. The third top panel 54 is additionally defined by fold line 67, which is parallel to fold line 22 and connects fold lines 66 and 72. A third top seal panel 85 is articulated to the rectangular third top panel 54 along fold line 67. The third top seal panel 85 is further defined by fold lines 84 and 90, which respectively colinearly extend from fold lines 66 and 72 to carton blank top edge 99. Third top seal panel 85 is further defined by carton blank top edge 99 which extends parallel to fold line 67 and connects fold lines 84 and 90. Generally centrally of panels 85 and 54, spaced lines of weakening 68,69 are provided, extending from carton blank edge portion 99, across third top seal panel 85, fold line 67, and third roof panel 54 to fold line 22. As will be explained in greater detail below, the lines of weakening 68,69 define portions 87 and 88 of the carton formed from the blank 10 which are converted to a pouring spout flap 55 on opening of the carton.

The fourth side panel 24 is further defined by parallel fold lines 25 and 26 which extend orthogonally between the fold lines 23 and 27. A triangular fourth bottom panel 39 is articulated to the fourth side panel 24 along fold line 25. The triangular fourth bottom panel 39 is further defined by converging fold lines 44 and 46. A triangular bottom fold panel 38 is articulated to triangular bottom panel 39 along fold line 44, is further articulated to the third bottom panel 37 along fold line 43 and has carton blank bottom edge portion 109. Similarly, a triangular fold panel 40 is articulated to triangular fourth bottom panel 39 along fold line 46. Fold panel 40 is further defined by fold line 47 in colinear alignment with fold line 27 and carton blank bottom edge portion 110.

A triangular fourth roof panel 58 is articulated to the fourth side panel 24 along fold line 26. Triangular roof panel 58 is further defined by converging fold lines 74 and 75. A first top fold panel 57 is articulated to third roof panel 54 along fold line 72. The first fourth top fold panel 57 is further defined by fold lines 72 and 73. The fold lines 72 and 73 respectively extend generally colineraly from fold lines 23 and 67. A second fourth top fold panel 59 is articulated to fourth roof panel 58 along fold line 75. The second fourth top fold panel 59 is further defined by fold lines 76 and 77. The fold lines 76 and 77 respectively extend generally colinearly from fold lines 27 and 73. A top seal panel 91 is respectively articulated to the first and second top fold panels 57 and 59 along fold lines 73 and 77. Top seal panel 91 is further defined by fold line 94 extending colinearly from fold line 76, and by carton blank top edge 93 extending from fold line 90 to fold line 94.

Side glue flap 28 is defined by fold line 27, carton side edge 31, lower fold line 29 and upper fold line 30. The fold lines 27, 29 and 30, upon erection of the carton, registering with carton edge 11 and adjacent portions of fold lines 13 and 14. A bottom glue panel 32 is articulated to bottom fold panel 40 on fold line 47 and to side glue flap 28 on fold line 29. The bottom glue flap 32 is further defined by side edge portion 112 extending from edge 31 to edge portion 111 and carton blank bottom edge portion 111. Top glue panel 48 is articulated to side glue panel 28 along fold line 30, to triangular top panel 59 along fold line 76 and is further defined by fold line 78 and carton blank side edge portion 89. Top seal panel glue flap 95 is articulated to top glue flap panel 48 along fold line 78 and to top seal panel 91 along fold line 94. Fold line 94 is colinear with fold line 76. Top seal panel glue flap 95 is further defined by the carton blank top edge portion 104 and side edge portion 96.

Figure 5:
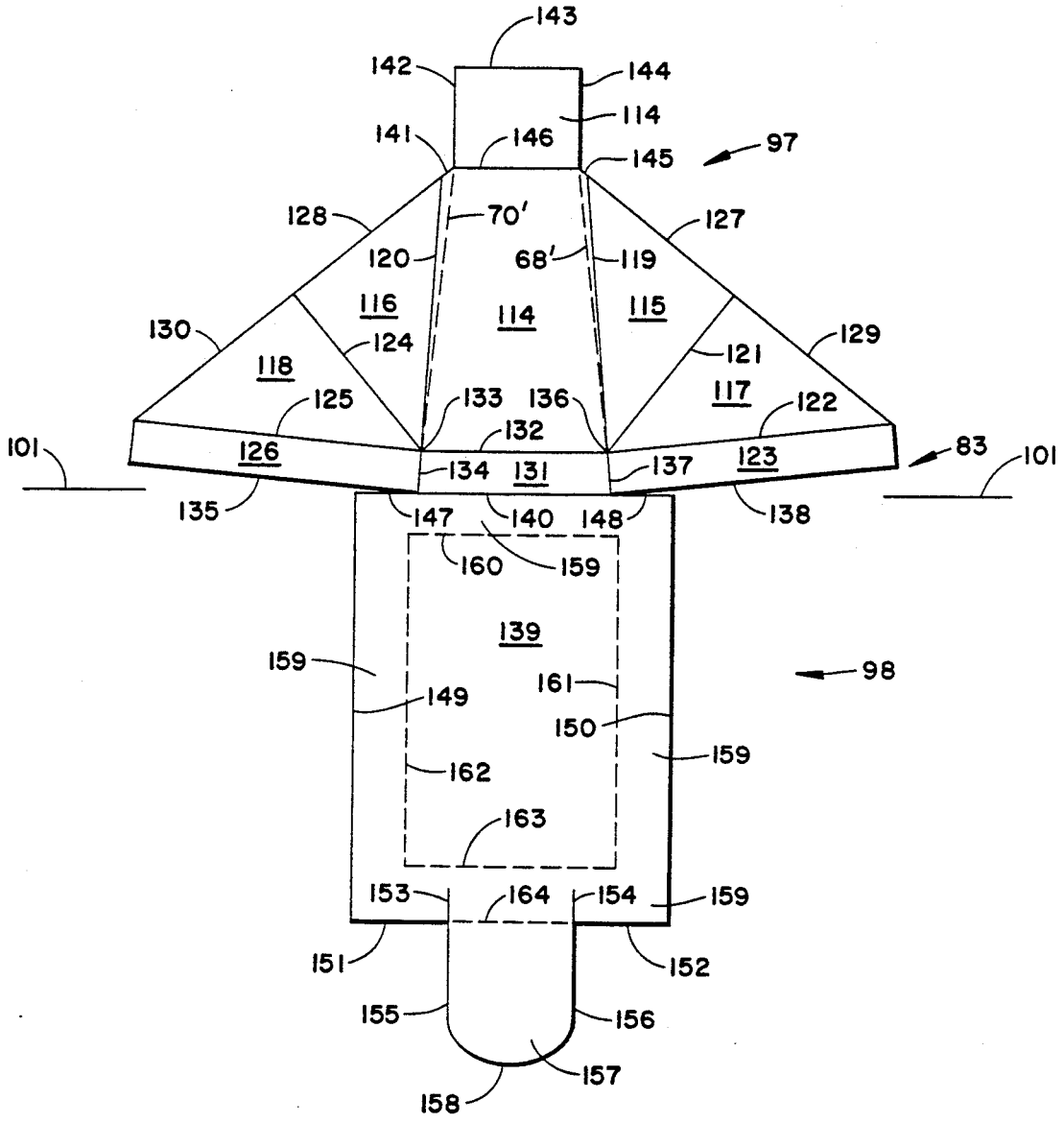
FIG. 5 is a view in plan of a combined pouring spout web blank and seal panel blank constructed in accordance with an embodiment of this invention.
Figure 7:
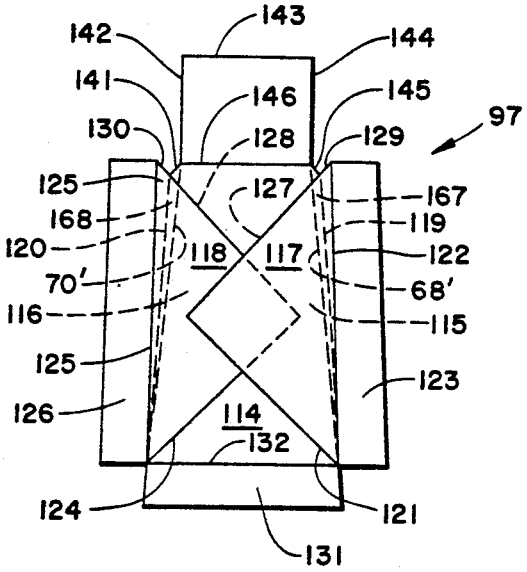
FIG. 7 is a plan view, from the direction of a carton blank, of a pouring spout web blank in folded condition.
Figure 9:
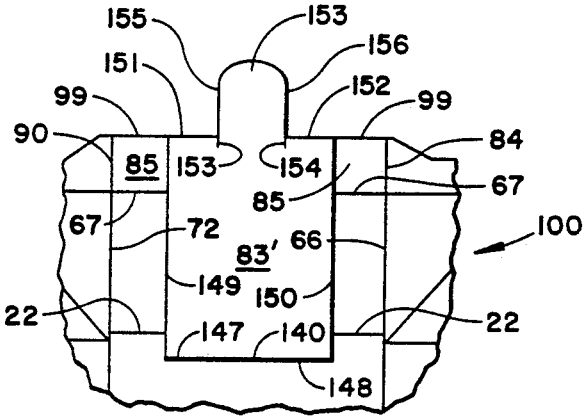
FIG. 9 is a fragmental view of a carton blank having a pouring spout and seal panel assembly mounted on the surface of the blank which will be inside the carton when erected.
Figure 8:
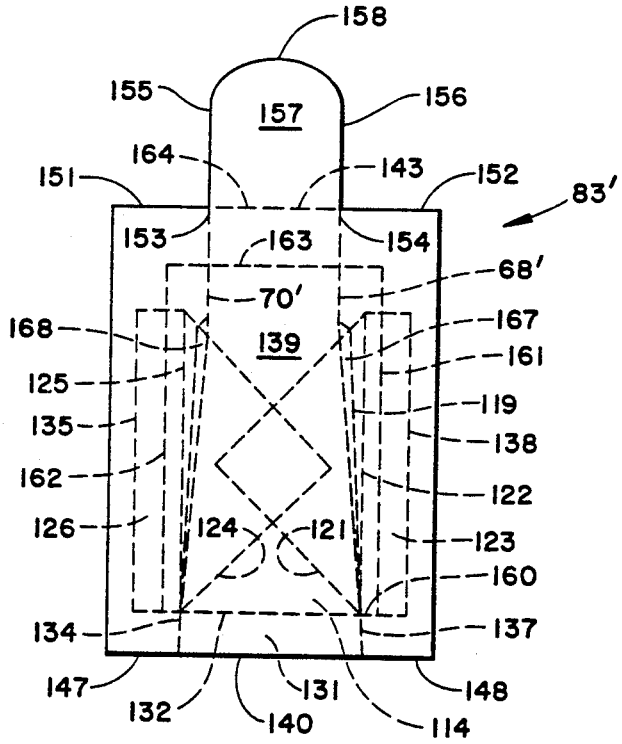
FIG. 8 is a plan view of a pouring spout and seal panel assembly in folded condition for application to a carton blank.

A spout and seal blank is illustrated in FIG. 5 and further in FIGS. 7, 8 and 9, and is identified generally by the reference number 83. The spout and seal blank 83 is formed from a flexible sheet material which is readily attachable to the paperboard material of the carton blank 10 and is additionally preferably formed from a material that can be readily folded so that it is readily refoldable in like fashion and is substantially liquid impervious to permit efficient sealing of the carton formed from the blank. A preferred material for the spout and seal blank is oriented polypropylene film such as Quantum Chemical Corporation CGW, CW and Normet CW. In certain embodiments, the spout and seal blank may be formed from a paperboard material similar to the paperboard material from which the carton blank 10 is formed. In other embodiments other flexible sheet materials having particular qualities related to the nature of the contents to be placed in the carton are also preferred for use in appropriate situations.

The spout and seal blank 83 consists of two general parts; the first a spout blank portion generally indicated by reference number 97 and a seal blank portion generally indicated by reference number 98. The spout blank portion 97 lies on one side of the line of meeting 101, while the seal panel blank portion 98 lies on the other side of the line of meeting 101 as shown in FIG. 5.

The spout blank 97 comprises a central panel 114, first pleat panel 115, second pleat panel 116, third pleat panel 117 and fourth pleat panel 118. Central panel 114 is articulated to first pleat panel 115 along fold line 119 and to second pleat panel 116 along fold line 120. First pleat panel 115 is articulated to third pleat panel 117 along fold line 121 and the third pleat panel 117 is articulated to first glue panel 123 along fold line 122. Similarly, second pleat panel 116 is articulated to fourth pleat panel 118 along fold line 124 and the fourth pleat panel is also articulated to second glue panel 126 along fold line 125. The first, second, third and fourth pleat panels have respective free edges 127, 128, 129 and 130. Central panel 114 is also articulated to central glue panel 131 along fold line 132.

Central glue panel 131 is severed from first glue panel 123 along cut line 137 extending from point 136 to free edge 138 of first glue panel 123 and central glue panel 131 is also severed from second glue panel 126 along cut line 134 extending from point 133 to free edge 135 of the second glue panel. Further, central glue panel 131 is also articulated to seal panel 139 along fold line 140 extending between cut line 134 and cut line 137. Seal panel 139 is not connected directly to first glue panel 123 or to second glue panel 126.

Central spout panel 114 is defined by fold lines 119, 132, 120 and edge portions 141, 142, 143, 144 and 145. Transverse fold line 146 extends between the junctures of edge portions 141,142 and 144,145.

As shown in FIG. 7, pouring spout blank portion 97 may be folded into the condition in which it is mounted on carton blank 10 as follows. The blank is first folded along fold line 120 so second pleat panel 116 overlies spout central portion 114 as shown in FIG. 7. Fourth pleat panel 118 is folded about fold line 124 to overlie second pleat panel 116 with its free edge 130 overlying free edge 128 of second pleat panel 116 and extending beyond fold line 120 to fold line 125 along which fourth pleat panel 118 is articulated to second glue panel 126. Similarly, by folding along fold line 119, first pleat panel 115 is folded into the position shown in FIG. 7 wherein it lies over central panel 114 and a portion of the folded pleat panels 116 and 118. The blank is then folded about fold line 121 to place third pleat panel 117 in overlying relation to pleat panel 115 with the free edge 129 of pleat panel 117 overlying the free edge 127 of first pleat panel 115 and extending outwardly beyond fold line 119 to fold line 122 along which third pleat panel 117 is articulated to first glue panel 123. When the spout blank is folded as shown in FIG. 7, the glue panels 123, 126 and 131 and the portion of the central panel 114 defined by dash line 68', fold line 132, dash line 70' and edge portions 142, 143 and 144 are in condition for application of a suitable adhesive on the far sides of those portions as viewed in FIG. 7 and application of the folded pour spout blank to carton blank 10 with dash line 68' and edge portion 144 respectively in registry with lines of weakening 68 in third roof panel 54 and third top seal panel 85, with dash line 70' and edge portion 142 respectively in registry with lines of weakening 69 in third roof panel 54 and third top seal panel 85, with fold line 132 coinciding with fold line 22 between lines of weakening 68 and 69 and with fold line 146 coinciding with fold line 67 of blank 10. When the folded spout blank is so positioned on carton blank 10, central glue panel 131 is adhered to third side panel 20 with fold line 132 coincident with fold line 22 and with first and second glue panels 123,126 adhered to third roof panel 54 in locations spaced laterally from lines of weakening 68,69 defining pouring spout flap 55 of the third roof panel 54 and third top seal panel 85. Fold line 146 extending transversely of central panel 114 also coincides with the fold line 67 along which third top seal panel 85 is articulated to third roof panel 54.

Seal blank portion 98 of blank 83 comprises a seal panel 139 and a tear-tab 157. Seal panel 139 is articulated to the spout blank portion 97 on fold line 140 and has edges 147,148 which are colinear with fold line 140 and extend in respective opposite directions from it to respective side edges 149 and 150 of the seal panel 139. Side edges 149 and 150 in turn respectively extend to colinear top edge portions 151 and 152. A tear-tab portion 157 extends between and beyond colinear top edge portions 151 and 152. Nicks or cuts 153 and 154 extend into seal panel 139 in alignment with side edges 155,156 of the tab 157 to facilitate tearing of the seal panel incident to opening the gable top carton, as will be hereinafter described. Side edges 155,156 are connected by tab end edge 158.

A suitable adhesive is applied to areas of the seal panel adjacent the edges 147, 149, 151, 152, 150, 148 and fold line 140 to adhesively secure and seal the perimeter areas of the seal panel 139 to carton blank 10 and preferably to central glue panel 131 as well as portions of first and second glue panels 123 and 126 and a portion of central panel 114 between edge 143 and fold line 146 so as to form an enclosure for the balance of central panel 114 and the pleat panels overlying it in folded relation so that, upon opening and reclosing of the carton as will be later described, the central panel and pleat panels are free to move as hereinafter described. As shown in FIGS. 7 and 8, the perimeter area to which glue is applied may substantially be the area 159, the inner edge of which is defined by dashed lines 160, 161, 162 and 163, and the outer edge of which is defined by fold line 140, edges 147, 149, 151, dashed line 164, edges 152, 150 and 148.

When the spout and seal panel 83 is folded to form the folded spout and seal blank 83' illustrated in FIG. 8 with glue applied to seal panel glue area 159, affixation of the folded blank 83' to carton blank 10 is completed, and the folded blank 83' is then secured in the position substantially as shown in FIG. 9 to produce a unified assembled carton blank 100.

Figures 4, 10:
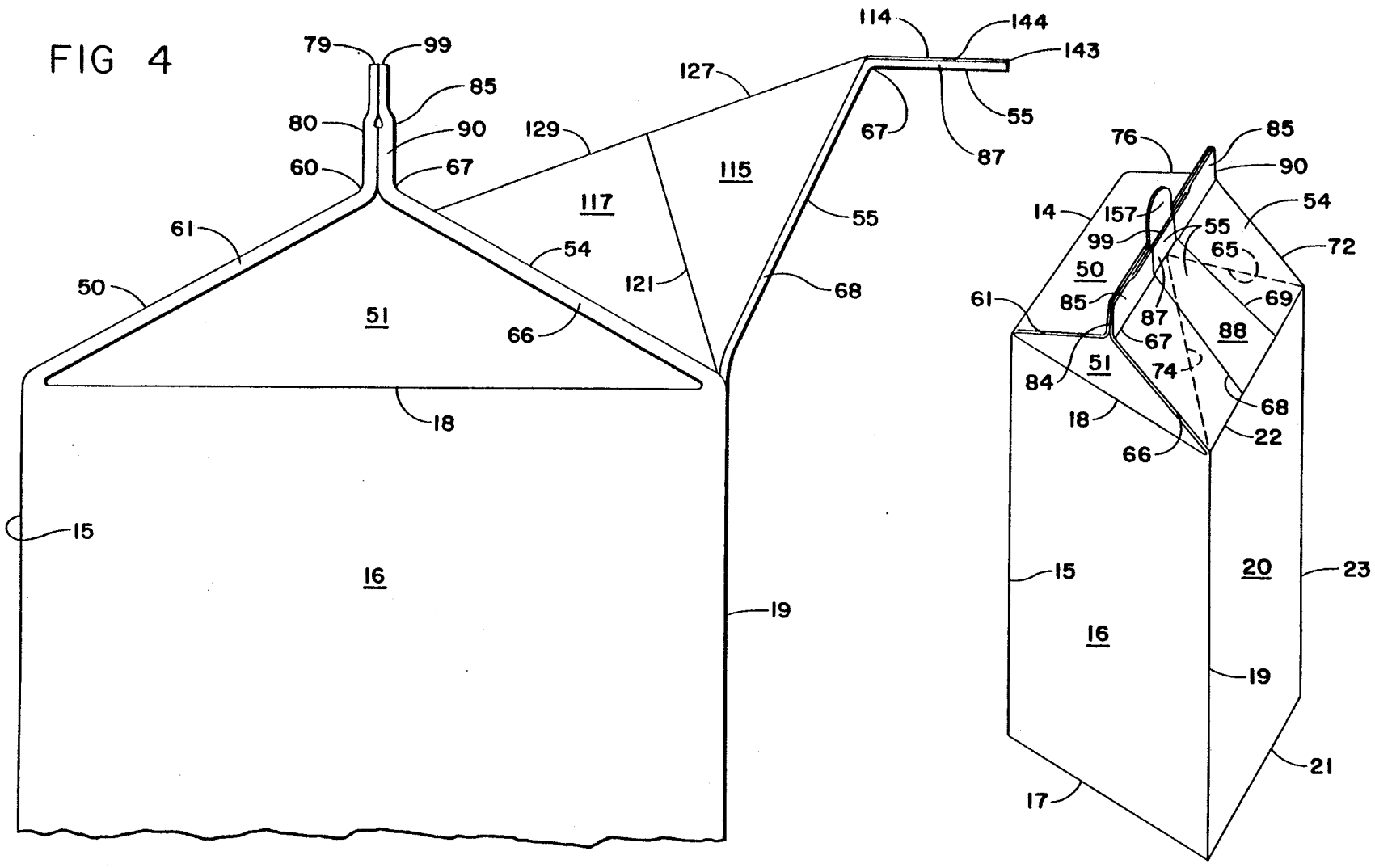
FIG. 4 is a fragmentary view in side elevation of the gable top carton of FIG. 1 with the pouring spout in full open position.
FIG. 10 is a view in perspective of an erected and sealed gable top carton embodying the instant invention.

The unified carton blank 100 may be erected in a conventional fashion to form a gable top carton 102 having an external configuration like the well known cartons having a gable openable to provide a pouring spout, except that at least a portion of flexible pull-tab 157 projects from the central portion of the ridge seam as shown in FIG. 10. The sloping rectangular roof panels 50, 54 are free of projections as might interfere with stacking of the errected cartons in the manner in which conventional gable top cartons are frequently stacked; namely, with cartons on one level standing with their ridge seams upward and on the second level stacked thereon, roof-panel-to-roof-panel, with their ridge seams extending downwardly, between the side walls of adjacent cartons so as to minimize the space required to store a given number of such cartons. The flexible character of the projecting tab 157 substantially obviates the likelihood of damage to the gable top carton that is present where more rigid projections are present as in the plastic spout type cartons described earlier herein.

Figure 1:
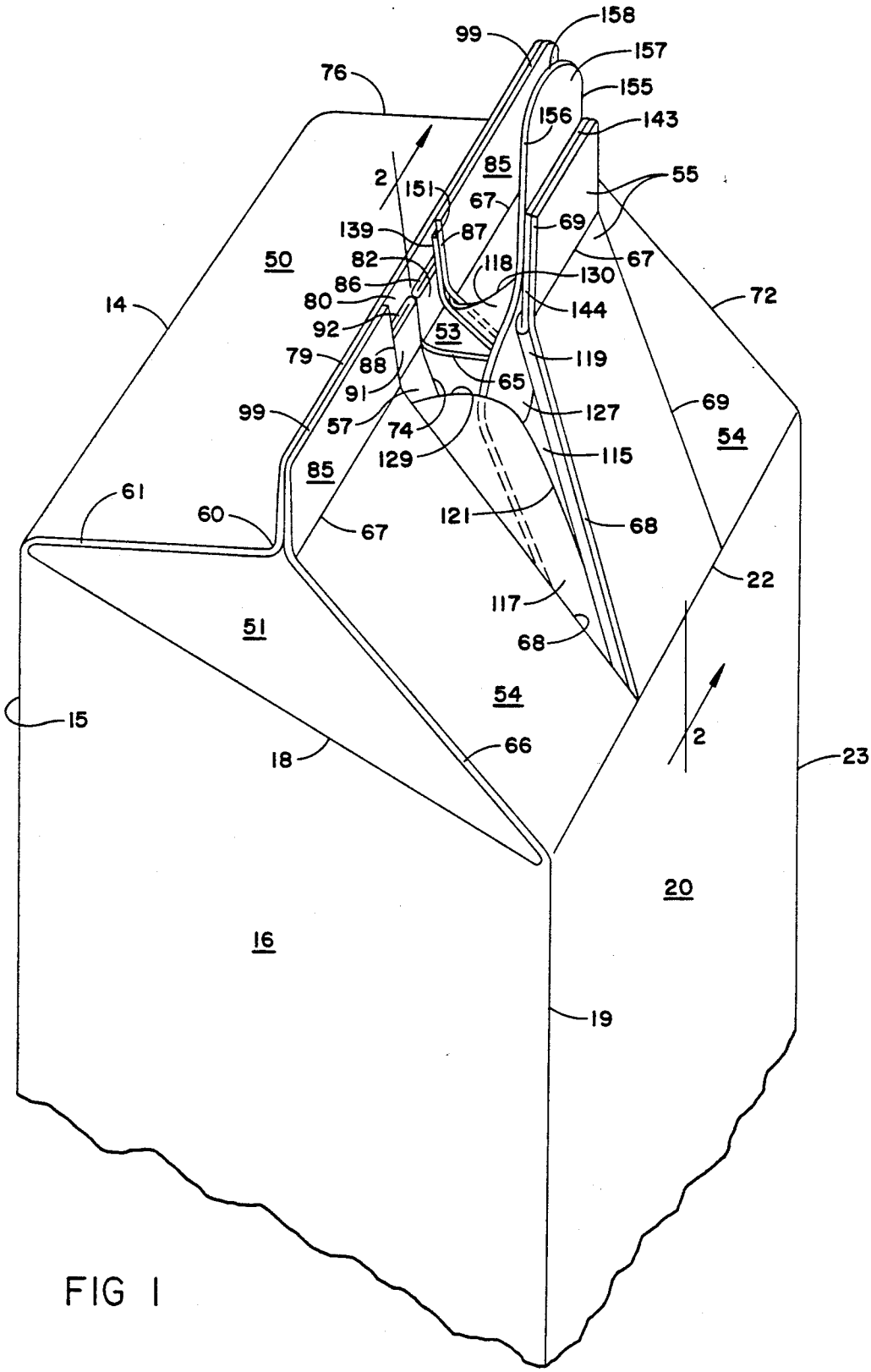
FIG. 1 is a fragmentary view in perspective of a gable top carton constructed in accordance with a preferred embodiment of this invention and with the pouring spout in partly open position.
Figure 3:
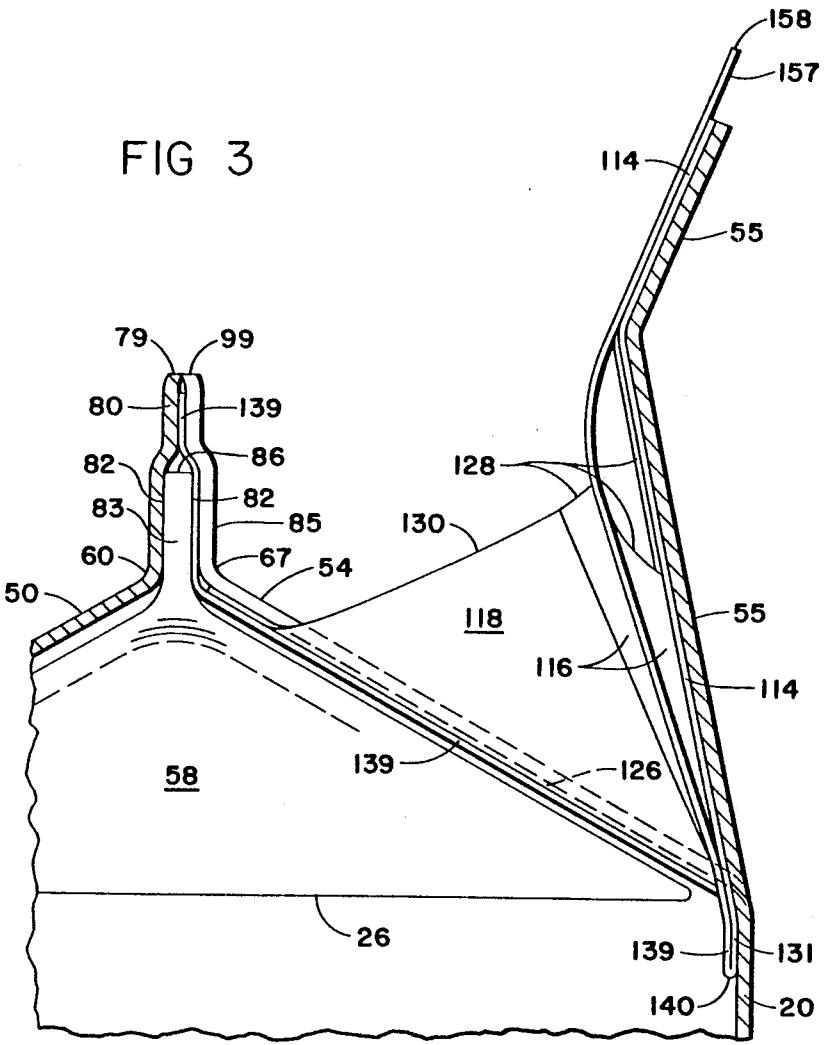
FIG. 3 is a fragmentary side view in vertical section taken in the same plane as and viewed in the same direction as FIG. 2, but with the pouring spout opened to a position intermediate the spout position of FIG. 1 and full open position.
Figure 2:
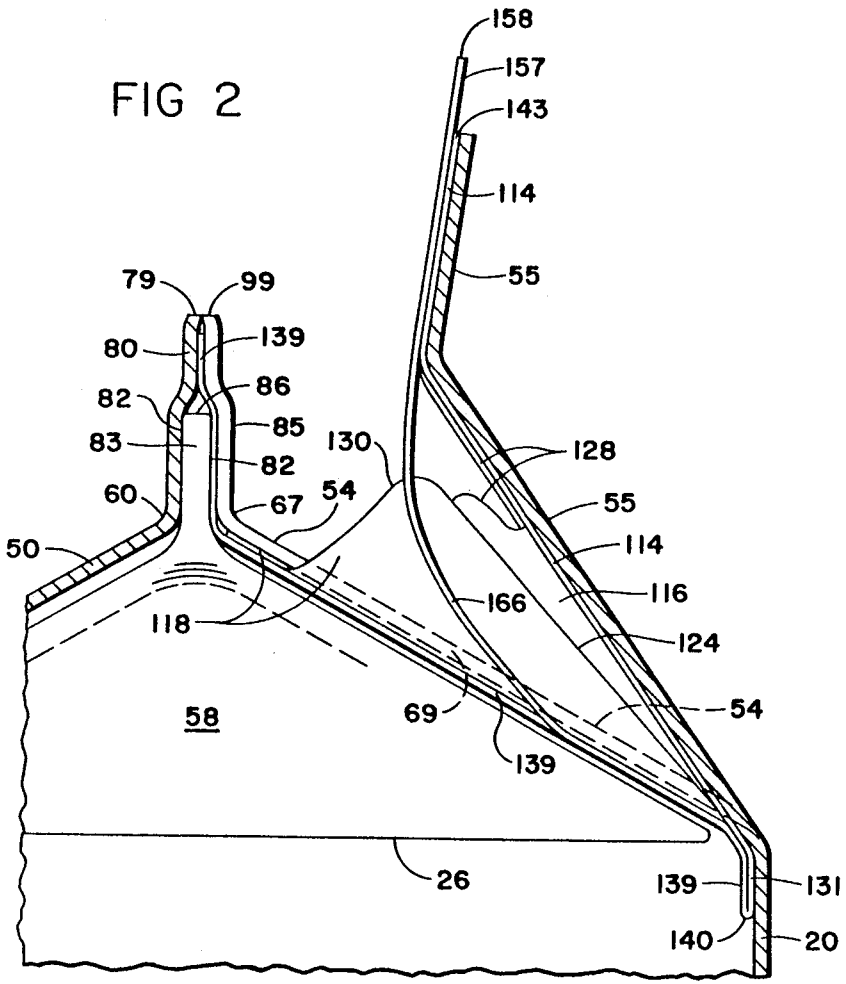
FIG. 2 is a fragmentary side view in vertical section on the center plane of the gable top carton shown in FIG. 1 and viewed in the direction of the arrows 2—2 in FIG. 1.

To open carton 102 and extend the pour spout into fully opened position for pouring the pourable contents from the carton, the pull-tab 157 is grasped and pulled to the right from the position in which it is shown in FIG. 10 toward the position in which it is shown in FIG. 1. As the tab is drawn to the right, the spout tab 55 at edge 99 begins to progressively separate from the other portions of seal panel 85 of the ridge seam and roof panel 54 along lines of weakening 68 and 69. Seal panel 139 laterally of tab 157 terminates either flush with edge 99 of top seal panel 85 or, as shown in FIG. 1, a short distance below it so that the nicks 153 and 154 are protected in the ridge seam, particularly where the seal panel is fabricated from a thin flexible material which has high resistance to tearing until a cut or nick can serve as the initiation of tearing, and therefrom the material tears readily against a supporting edge. As tearing progresses along lines of weakening 68 and 69, the central portion of the seal panel 139 underlying spout tab 55 is drawn upward through the opening created by tearing of spout flap 55 from the seal panel 85 and roof panel 54. The points of tearing of seal panel 139 trail behind the points of tearing of the spout flap from seal panel 85 and roof panel 54 so that an edge of blank 10 exists ahead of the points at which tearing of the seal panel progresses against edges 68 and 69, as is indicated in FIGS. 1, 2 and 3. As the portion of seal panel 139 has progressively torn loose from the portions thereof which remain mounted in the ridge seam and against the underside of roof panel 54, the strip-like portion being torn loose, 166, underlies and progressively engages the inward faces of the pleat panels which, at the time opening of the carton is commenced, lie folded between seal panel portion 166 and central panel 114, the latter being adhesively secured to the inward face of pour flap 55 moves in unison with that flap. However, as seal panel portion 166 trails behind the pour flap, the pleat panels are afforded space in which to be drawn from their location between members 114 and 166 and are wedged into spaced progressively extended relation by the drawing of seal panel portion 166 along in the wake of pour spout flap 55, as is shown in FIGS. 1, 2 and 3. The pleat panels are fully extended when the spout flap 55 is in fully opened position as shown in FIG. 4. When the spout has been extended as shown in FIG. 4, it is permitted to partially swing back toward its original position so that the portion 166 of the seal panel may be grasped to pull it and tab 157 from spout central panel portion 114 and to further manipulate it to tear from line of weakening 68 to line of weakening 69 substantially along line 132 shown in FIG. 5.

If articles are enclosed between the folded pleat panels and central panel 114, portion 166 tends to restrain those articles in proximity to panel 114 as portion 166 is adhesively secured to central panel 114 from edge 143 thereof to edge 163 of seal panel glue area 159 and also to central glue panel 131. Portion 166 overlies the folded pleat panel portions and spans the space between the pleat panels when the latter are extended. The extended pleat panels concurrently laterally restrain the articles enclosed. When the spout flap is permitted to swing back from fully opened to partially closed condition, the consumer opening the package may slip a finger between portion 166 of the seal panel and the pleat panels and the central panel and pinch the enclosed articles against the adjacent pour spout central panel 114 while tearing of portion 166 out of the container is completed, as noted above.

As the edges of the opening in top seal panel 85 and roof panel 54 conform with the lateral edges of the pour spout flap and the edge 144 and dash line 68' extending to point 136 of the pour spout panel on one side and edge 142 and dash line 70' extending to point 133 on the other side of the spout as shown in FIGS. 5, 7 and 8, central panel 114 has triangular lateral portion 167 defined by fold line 119, edge 145 and dash line 68' on one side and triangular portion 168 defined by fold line 120, edge 141 and dash line 70' on the other. When the spout panel portion is folded as shown in FIGS. 7 and 8, the projecting triangular portions 167,168 are doubled from adjacent carton fold line 67 to points 136 and 133. Thus, as the pour spout is reclosed, the pleat panels are refolded to the position in which they are shown in FIGS. 7 and 8, the triangular portions 167,168 project in overlying relation to the top surface of roof panel 54, but as pour spout flap 55 is swung through the opening in the roof panel 54, it draws the triangular projecting portions 167,168 into the interior of the carton and draws the portion of the tongue spout torn from top seal panel 85 into a position in which the fold therein on line 67 is drawn below fold line 67 located at the juncture of roof panel 54 and top seal panel 85. Once the fold line edges 119,120 of the laterally projecting triangular portions 167 and 168 are drawn into the interior of the carton, the flexible projecting portions 167,168 expand to underlie the underside of roof panel 54 and overlie the portions of pleat panels 117,118 subjacent roof panel 54. The resilience of spout flap 55 tends to cause the spout flap 55 to straighten and, through cooperation with the adjacent portion of the ridge seam, rises up so that spout flap 55 is in flush condition with roof panel 54 and the portion of spout flap 55 torn from the ridge seam is substantially returned to the position from which it was torn upon opening of the carton, thus substantially resealing the carton and retaining the pour spout in closed position. The upper end of the opening in the carton 102 is defined by fold line 65 along which panels 53 and 51 are articulated, and fold line 74 along which panels 57 and 58 are articulated. Triangular portions of panels 53 and 57 adjacent top seal panels 82,91 extend beneath central panel 114 and pouring spout flap 55.

Once reclosed, the consumer may press a thumb or finger against the pour spout flap portion 55 to urge it against the ridge seam and against the underlying triangular portions of panels 53 and 57 above the opening in the container to hold the carton closed and preclude leaking of the pourable contents during shaking of the carton and contents where such mixing of the pourable contents may be desired. The resistance to leakage is enhanced by the fact that triangular portions 167,168 of the central panel and first and second pleat panels, upon expanding inside the carton after passing through the opening in the roof panel 54, extend into a cavity between the roof panel 54 and the pleat panels 117,118 articulated to first and second glue panels 123,126 and also overlap respective portions of panels 53 and 57 adjacent the side edges of the pour spout opening in roof panel 54 to contribute substantial baffle sealing along the side edges of the pour spout opening in roof panel 54.

In some instances it may be desirable to completely remove pouring spout flap 55 on opening of the carton to leave the web to serve as the spout and for reclosing of the carton. In such instances only a width-wise portion of web central panel 114 from adjacent fold line 146 to a line parallel to but short of edge 143 is adhered to carton portion 87 by adhesive which will release under forces less than those necessary to tear seal panel 139 or to detach seal panel 139 from carton panels 20, 54, 85, 82 and 91. The unadhered portion of carton portion 87 of pouring spout flap 55 at edge 99 provides a tab by which flap 55 may be gripped and torn free of third roof panel 54 along lines of weakening 68,69 to the top of wall portion 20 and then severed adjacent line 22 to complete detachment of pouring spout flap 55 from the carton. The spout web may then be drawn outwardly to form an open discharge spout or to expose an inner seal panel for rupture establishing communication between the carton chamber behind the inner seal panel for discharge of carton contents through the open spout.

The gable top carton embodying my invention illustrated in the drawings and described above is presently considered to be a preferred embodiment of my invention and subject to structural modification without departing from the spirit and scope of the invention.

Having described my invention, what I claim as new and desire to secure by Letters Patent is:

1. A reclosable gable top carton comprising a bottom wall, an upstanding side wall connected to and extending from said bottom wall and a gable top connected to and extending from portions of the side wall opposite the bottom wall of the carton, said gable top comprising:

a pair of opposed converging rectangular roof panels connected to and extending from opposed top portions of the upstanding side wall, a pair of opposed triangular top panels articulated to opposed top portions of said side wall, opposed pairs of top fold panels respectively articulated to and extending between one of said rectangular roof panels and a corresponding one of said triangular top panels, respective top seal panels connected to each rectangular roof panel and top fold panel and extending to an edge remote from said respective panel, the top seal panels joined in a ridge seam extending upwardly from the roof panels, a selected one of said rectangular roof panels and respective top seal panel connected thereto being provided with lines of weakening defining a pouring spout flap extending from the upstanding side wall to the top edge of the top seal panel and swingable about the top of the upstanding side wall when the lines of weakening are severed, portions of the top fold panels articulated to said selected roof panel underlying the pouring spout flap adjacent the ridge seam, a spout web member having a central portion attached to an inner face of the pouring spout flap, web accordian pleat panels articulated to the central panel along fold lines defining opposite respective sides of said central panel, a bottom glue panel articulated to said central panel and outer glue panels articulated to said web accordian pleat panels and attached to an inner face of the respective roof panel adjacent but spaced from the spout flap, the pouring spout flap swinging between closed position in which the pouring spout flap is aligned with said roof panel and top seal panel, an open position in which the accordian pleat panels are extended, a past closed position in engagement with said underlying portions of triangular top fold panels and to closed position aligned with the adjacent roof and top seal panel portions whereby a sealed gable top carton is provided having a pouring spout which may be opened, reclosed and resealed by finger pressure on the spout while the carton is shaken to mix the carton contents.

2. A gable top carton as in claim 1 wherein at least a portion of the central web portion spanning a portion of a line of weakening overlaps a portion of the inward face of the rectangular roof panel between a line of weakening and an outer glue panel to resist movement of the spout flap from closed toward open position after said lines of weakening are severed, the spout flap swinging from a closed position in which the spout flap is aligned with the adjacent rectangular roof and top seal panel portions and the central web portion overlapping a portion of the inward face of the rectangular roof portion, drawing the said overlapping web portion out of the carton as the spout is advanced to an open position in which the accordian pleat panels are extended outwardly of the roof panel, to an inward position in engagement with underlying triangular top fold panel portions adjacent the ridge seam with the line of weakening spanning portions of the central web extending adjacent the inner face of the roof panel, and swinging outwardly into closed position in aligned relation with adjacent rectangular roof and top seal panel portions with the central web line of weakening spanning portions in engagement with the underside of the adjacent rectangular roof panel portions.

3. A gable top carton as in claim 1 wherein there is a major chamber and a minor chamber separated by an inner seal panel, the inner seal panel separating the pouring spout from the major chamber.

4. A gable top carton as in claim 2 wherein there is a major chamber and a minor chamber separated by an inner seal panel, the inner seal panel separating the pouring spout from the major chamber.

5. A gable top carton as in claim 1 having an inner seal panel attached to the inward face of the rectangular roof and top seal panels annularly of at least the rectangular roof panel portion of the spout flap and accordian pleat panels and underlying the spout flap and web portions to form a minor chamber between at least a portion of the in-facing side of the rectangular roof panel and spout flap and the inner seal panel.

6. A gable top carton as in claim 2 having an inner seal panel attached to the inward face of the rectangular roof and top seal panels annularly of at least the rectangular roof panel portion of the spout flap and accordian pleat panels and underlying the spout flap and web portions to form a minor chamber between at least a portion of the in-facing side of the rectangular roof panel and spout flap and the inner seal panel.

7. A gable top carton as in claim 1 wherein the accordian pleat panels are paired and overlie the central web portion, a first pair of accordian pleat panels extend between the second pair of accordian pleat panels and the central web portion, and the second pair of accordian pleat panels extend between the first pair of accordian pleat panels and an inner seal panel, the accordian pleat panels and the central web portion being adapted to confine articles enclosed in the minor chamber in desired position.

8. A gable top carton as in claim 2 wherein the accordian pleat panels are paired and overlie the central web portion, a first pair of accordian pleat panels extend between the second pair of accordian pleat panels and the central web portion, and the second pair of accordian pleat panels extend between the first pair of accordian pleat panels and an inner seal panel, the accordian pleat panels and the central web portion being adapted to confine articles enclosed in the minor chamber in desired position.

9. A gable top carton as in claim 1 wherein the inner seal panel resistant to tearing except from nick cuts in its edge has nick cuts registering with the spout flap defining lines of weakening in the top seal panel, the nick cut portion of the inner seal panel being secured to the spout flap and guarded in the ridge seam against tearing whereby a strip of substantially like dimensions is torn from the inner seal panel against and along the edges of the spout flap opening provided in the top seal and rectangular roof panels as the spout flap edges are severed from the top seal and rectangular roof panel along the lines of weakening, said strip torn from the inner seal urging web portions toward the spout flap to confine articles in the minor chamber in desired position as the spout flap edges are severed from said roof and top seal panels.

10. A gable top carton as in claim 2 wherein the inner seal panel resistant to tearing except from nick cuts in its edge has nick cuts registering with the spout flap defining lines of weakening in the top seal panel, the nick cut portion of the inner seal panel being secured to the spout flap and guarded in the ridge seam against tearing whereby a strip of substantially like dimensions is torn from the inner seal panel against and along the edges of the spout flap opening provided in the top seal and rectangular roof panels as the spout flap edges are severed from the top seal and rectangular roof panel along the lines of weakening, said strip torn from the inner seal urging web portions toward the spout flap to confine articles in the minor chamber in desired position as the spout flap edges are severed from said roof and top seal panels.

11. A plurality of blanks for forming a gable top carton, comprising:

a carton blank formed from a single sheet of paperboard material and comprising at least one side wall panel, at least one bottom wall panel articulated to said side wall panel, a pair of rectangular roof panels articulated to said at least one side wall panel, a pair of top seal panels articulated to respective said rectangular roof panels, one of said rectangular roof panels and the respective top seal panel being provided with spout flap defining severable lines of weakening extending from adjacent a side wall panel to the blank edge, a pair of triangular top panels articulated to said at least one side wall panel and a plurality of triangular fold panels articulated respectively intermediate the triangular top panels and the rectangular roof panels, top seal panels respectively articulated to said triangular fold panels, and a pouring spout web blank having a central panel attached to and dimensioned to substantially completely cover the inward face of the spout flap portion of the carton blank, web accordian pleat panels articulated to the central panel along fold lines defining opposite respective sides of said central panel, a bottom glue panel articulated to said central panel and outer glue panels articulated to said web accordian pleat panels and attached to an inner face of said rectangular roof panel adjacent but spaced from the spout flap portion, whereby said bottom and side glue panels are selectively secureable to the carton blank at locations thereon substantially surrounding the spout flap portion of said rectangular roof panel thereof such that the spout flap and web blank are selectively openable and closable relative to the spout flap opening in the said rectangular roof panel and top seal panel of said carton blank.

12. A plurality of blanks for forming a gable top carton as in claim 11 wherein the fold lines defining opposite respective sides of said central panel extending from ends adjacent a side wall panel and between the said lines of weakening across said lines of weakening to opposite ends adjacent a said top seal panel.

13. A plurality of blanks for forming a gable top carton as in claim 11 wherein an inner seal panel blank overlies said pouring spout blank and is adhered adjacent its edges to the carton blank and at least a portion of the web blank, the inner seal blank having a grippable tab secured to and aligned with the central panel of the pouring spout blank adjacent the edge of the carton blank.

14. A plurality of blanks for forming a gable top carton as in claim 12 wherein an inner seal panel blank overlies said pouring spout blank and is adhered adjacent its edges to the carton blank and at least a portion of the web blank, the inner seal blank having a grippable tab secured to and aligned with the central panel of the pouring spout blank adjacent the edge of the carton blank.

15. A plurality of blanks for forming a gable top carton as in claim 13 wherein the inner seal panel blank has substantial resistance to tearing of its edges but is readily tearable to extend cuts in its edges, and said inner seal blank has a pair of cuts in its edges laterally of the grippable tab and each aligned with a respective spout flap defining severable line of weakening adjacent the edge of the carton blank.

16. A plurality of blanks for forming a gable top carton as in claim 14 wherein the inner seal panel blank has substantial resistance to tearing of its edges but is readily tearable to extend cuts in its edges, and said inner seal blank has a pair of cuts in its edges laterally of the grippable tab and each aligned with a respective spout flap defining severable line of weakening adjacent the edge of the carton blank.

17. A plurality of blanks for forming a gable top carton, comprising:

a carton blank formed from a single sheet of paperboard material and comprising at least one side wall panel, at least one bottom wall panel articulated to said side wall panel, a pair of rectangular roof panels articulated to said at least one side wall panel, a pair of triangular top panels articulated to said at least one side wall panel and a plurality of triangular fold panels articulated respectively intermediate the triangular top panels and the rectangular roof panels, respective top seal panels connected to each rectangular roof panel and top fold panel and extending to an edge of the blank remote from said respective panel, one of said rectangular roof panels and the respective top seal panel connected thereto being provided with lines of weakening defining a pour spout flap extending from adjacent the upstanding side wall to the edge of the top seal panel remote from the roof panel, and a pouring spout web member blank having a central portion attached to an inner face of the defined pouring spout flap, web accordian pleat panels articulated to the central panel along fold lines defining opposite respective sides of said central panel, a bottom glue panel articulated to said central panel and outer glue panels articulated to said web accordian pleat panels and attached to an inner face of the respective roof panel adjacent but spaced from the defined pouring spout flap, whereby said bottom and side glue panels are selectively securable to the carton blank at locations thereon substantially surrounding the bottom and sides of the pouring spout flap portion of the roof panel such that the pouring spout web member blank is selectively openable and reclosable relative to the pouring spout flap portion of the carton blank roof panel.

18. A gable top carton as in claim 17 having an inner seal panel attached to the inward face of the rectangular roof and top seal panels annularly of at least the rectangular roof panel portion of the spout flap and accordian pleat panels and underlying the spout flap and web portions to form a minor chamber between at least a portion of the in-facing side of the rectangular roof panel and spout flap and the inner seal panel.

19. A gable top carton as in claim 1 wherein the said web central panel is less strongly adhesively attached to the portion of the pouring spout flap in the ridge seam than to other portions of the seam so the spout flap may be torn free of the web in the ridge seam and of the roof panel and detached from the carton, whereby the spout web serves as a pouring spout and carton reclosure following detachment of the flap.

* * * * *